United States Patent [19]

Ream

[11] Patent Number: 4,457,403

[45] Date of Patent: Jul. 3, 1984

[54] SELF-PROPELLED ELEVATING WORK PLATFORM

[75] Inventor: Michael D. Ream, Lafayette, Calif.

[73] Assignee: Up-Right, Inc., Berkeley, Calif.

[21] Appl. No.: 418,711

[22] Filed: Sep. 16, 1982

[51] Int. Cl.[3] ..... B66B 11/04

[52] U.S. Cl. ..... 187/18; 182/141; 254/122

[58] Field of Search ..... 187/18, 8.72; 254/122, 254/10 R; 182/69, 63, 157, 141, 14, 16

[56] References Cited

U.S. PATENT DOCUMENTS 2,402,579 6/1946 Ross ..... 187/18

3,259,369 7/1966 Gridley ..... 187/18

*Primary Examiner*—Joseph J. Rolla

*Assistant Examiner*—Kenneth Noland

*Attorney, Agent, or Firm*—Phillips, Moore, Lempio & Finley

[57] ABSTRACT

A mobile scaffold unit having a wheeled base frame and a horizontal work platform, interconnected by upper end lower scissors sets. Each scissors set has a power arm and a stabilizer member, and the upper and lower pivotally connected power arms have a hydraulic ram connected therebetween. The upper and lower power arms are pivotally connected to the platform and base frame respectively and have a length greater than the length of the platform, with the ram being connected to the power arms beyond the platform. The width of the scissors set is considerably less than the distance between the wheels on opposite sides of the frame, enabling the scissors set to be disposed between the wheels and to be mounted to the base frame at a level considerably below the upper surfaces of the wheels. The power arms are made up from three beams connected in a fork manner and provide two parallel beams where the forces are greatest and a single beam where forces are relatively low.

10 Claims, 8 Drawing Figures

SELF-PROPELLED ELEVATING WORK PLATFORM

DESCRIPTION

1. Technical Field

This invention relates to mobile scaffold units and in particular, to self-propelled mobile scaffold units having an elevatable work platform.

2. Background of the Invention

Mobile scaffold units are presently available which have a generally rectangular work platform mounted on a wheeled base and a mechanism for raising and lowering the work platform.

Desirably, such units should have the following features. The deck of the work platform should be large and free from surface interruptions which would impede free movement of a workman about the platform. At the same time, the length and width of the unit should be small enough to permit the unit to be maneuvered through narrow aisles and around restricted corners. The height of the platform, when lowered, should be as low as possible, to permit movement of the unit through areas of restricted height clearance, and to present a convenient height for manual loading of tools and materials onto the platform. The maximum working height of the extended platform, relative to the wheelbase and width, should be as great as possible. Further, the unit should be structurally efficient and have a minimum cost of construction.

Currently available devices can be divided into two basic designs.

The first basic design is one having a wheeled base and a work platform, with multiple scissors sets no longer than the work platform being used to elevate the platform. Examples of such units are those shown in U.S. Pat. Nos. 3,961,681 and 4,113,065. In such a design, the hydraulic rams which are connected to the scissors sets to cause extension and retraction thereof are located under the platform. Typically, the scissors set includes two, horizontally spaced, tubular beams, acted upon by the lift rams, with at least two tubular cross-members tying the beams together.

Such a design enables a highly maneuverable unit to be made with an unobstructed platform deck area which is large relative to the spacing of the wheels on the base.

Such design has, however, a number of disadvantages. In order to reach an acceptable maximum working height, three (and sometimes four) scissors sets are required. The greater the number of scissors sets, the greater the closed platform height and the higher the headroom needed to move the scaffold unit from one place to another. Additionally, the greater the number of scissors sets, the greater the number of parts and the greater the expense. Particularly is this true because of the greater number of expensive pivot pin joints and hydraulic rams that are needed.

Typically the scissors-lift systems use horizontally spaced apart beam construction, with those beams which are operated upon by the cylinders having a uniform cross section throughout their length. Such construction results in more material being used than is necessary, since high bending moments occur only near the cylinder mounting points. The use of unnecessary material increases the expense and requires greater forces to raise the weight of such material.

The other type of currently available device has a lower lift arm pivotally connected at one end to a wheeled base frame and at its other end to an upper lift arm overlying the lower arm. A work platform is carried in cantilever manner by the other end of the upper arm. A hydraulic lift ram is mounted between the lower arm and the wheeled base, and an actuating link is used to open the upper arm relative to the lower arm as the latter pivots upwardly. A parallelogram linkage associated with the lift arms maintains the platform level relative to the base frame as the platform is raised or lowered.

Such type has several advantages. The lift arms are longer than the work platform, enabling an acceptable maximum working height to be obtained with only two lift arms. Also, the arms are relatively narrow, and extending them beyond either end of the base will not unduly increase the outside turning radius of the unit so as to decrease the maneuverability thereof.

At the same time, such devices have a number of disadvantages. Although only two lift arms are needed, a large number of pivot pin joints are required for the arms and for the parallelogram linkage systems. The high forces in the parallelogram and actuating links require large expensive bearings. The mounting of the lift ram between the lower arm and the base results in high bending forces in the base frame and require the use of a heavier and more expensive base. In like manner, the cantilever mounting of the work platform on the upper lift arm results in high bending forces in the platform, requiring the use of a heavier, more expensive work platform.

It is the principal object of the present invention to provide a self-propelled elevating work platform which combines elements of currently available devices in a unique configuration that eliminates the disadvantages of these devices while retaining the advantages thereof.

It is a further object of the invention to provide a self-propelled elevating work platform having a minimum platform height which is considerably lower than possible with currently available designs.

It is still a further object of the invention to provide a self-propelled elevating work platform having a high degree of structural efficiency so that minimum weight, and minimum manufacturing and operating costs can be obtained.

Other objects and advantages of the present invention will be apparent from the drawings and the following detailed description of the invention.

SUMMARY OF THE INVENTION

In one aspect of the invention, an elevatable work platform apparatus is provided having a horizontal frame, a horizontal work platform thereabove, the platform and base being interconnected by extendible upper and lower scissors sets, each scissors set having a power arm and a stabilizer member, the power arms being longer than the platform and extending lengthwise beyond the platform end when the platform is in lowered position. A generally vertical ram is connected between the power arms of the scissors sets at a location thereon beyond the platform end, and with the ram cylinder extending upwardly from the upper power arm.

A further aspect of the invention is that the work platform apparatus has first and second pairs of wheels mounted on the base frame, with at least one set of wheels being steerable, and that the width of the scissors sets is substantially less than the spacing between the inner surface of the wheels and that the lower scissors set is connected to the base frame at a level substantially lower than the upper surfaces of the wheels.

Yet another aspect of the invention is that the power arms of the scissors sets are comprised of three parallel tubular members, connected together in a fork configuration to match the strength of the power arms to the shear and moment forces imposed thereon.

Other objects and advantages will become apparent in the course of the following detailed description.

DESCRIPTION OF THE PREFERRED EMBODIMENT

Figure 1:
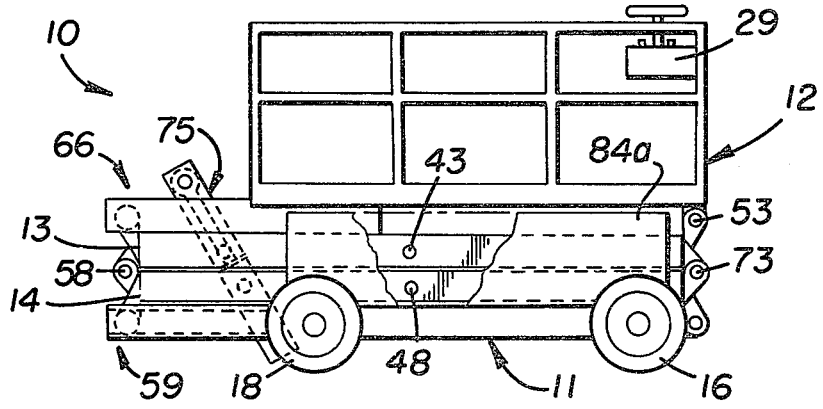

Referring now to the drawings, wherein a preferred embodiment of the invention is illustrated, FIG. 1 illustrates as a mobile scaffold unit 10 having a horizontal base frame 11, a generally rectangular and horizontal work platform 12 above the base frame 11 and upper and lower scissors sets 13 and 14 for raising and lowering the platform.

A first pair of wheels **16,16*a* is mounted on the base frame 11 at one end 17 thereof. A second pair of wheels 18,18*a* is mounted on the base frame 11 towards the other end 19 thereof. The wheels 16,16*a*** are mounted in a conventional manner so that they may be pivoted in unison for steering purposes.

Figure 5:
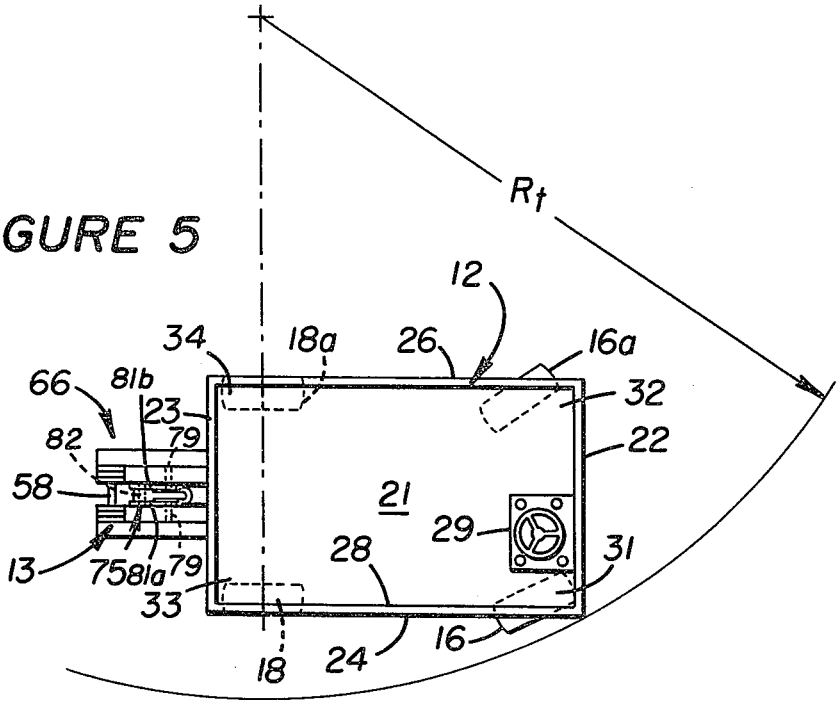
FIG. 5 is a plan view of the mobile scaffold of FIG. 1.
Figure 6:
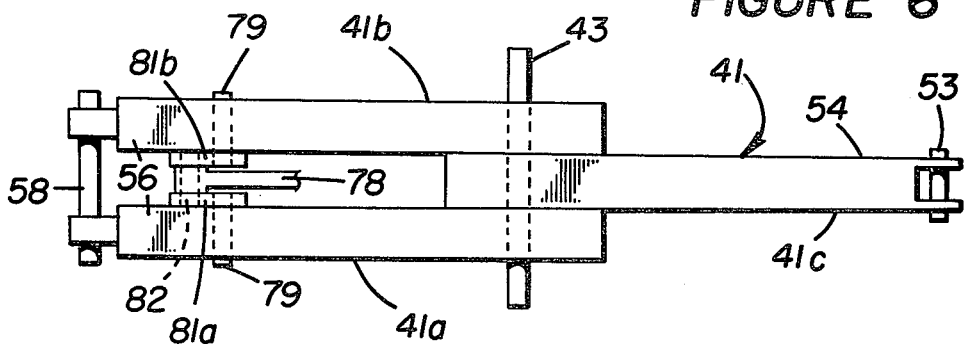
FIG. 6 is a simplified plan view of one of the elongated power arms of the mobile scaffold of FIG. 1.

As seen in FIGS. 1 and 5, the work platform 12 has a horizontal deck 21 extending the length, i.e., from end 22 to end 23, and width, i.e., from side 24 to side 26 of the platform, the deck 21 being unobstructed throughout its area. The work platform includes an upstanding toe board 27 and a guard rail system 28 surrounding the perimeter of the deck 21. A control panel 29 is mounted at a convenient place on the guard rail system 28, and has conventional controls for enabling a workman on the platform to drive the mobile scaffold forwardly or rearwardly, to steer the device, and to raise or lower the work platform.

As seen in FIGS. 1 and 5, wheels 16 and **16*a* are spaced below corners 31 and 32 at platform end 22 while wheels 18 and 18*a* are spaced below corners 33 and 34 at platform end 23, to provide for high maneuverability and stability. Preferably the spacing between the outside surfaces 26 (FIG. 4**) of the wheels of a pair thereof is no greater than the width of the work platform so that a side of the platform may be positioned flush against a vertical wall.

Figure 3:
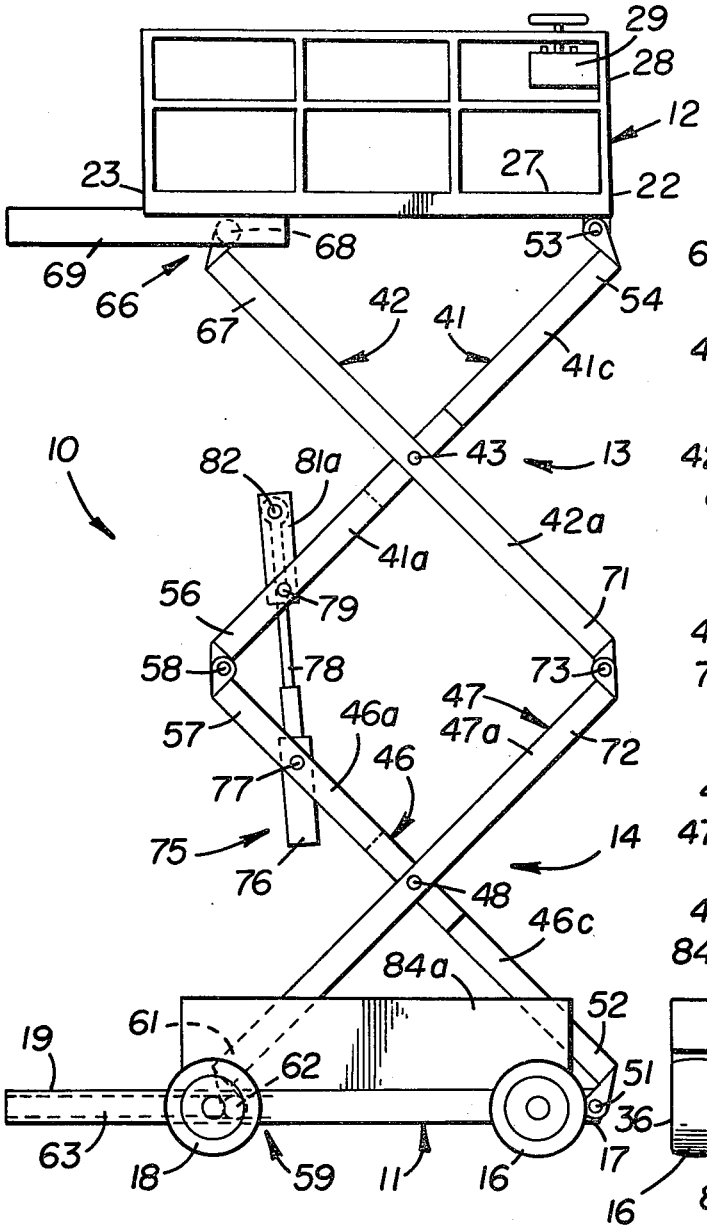
Figure 4:
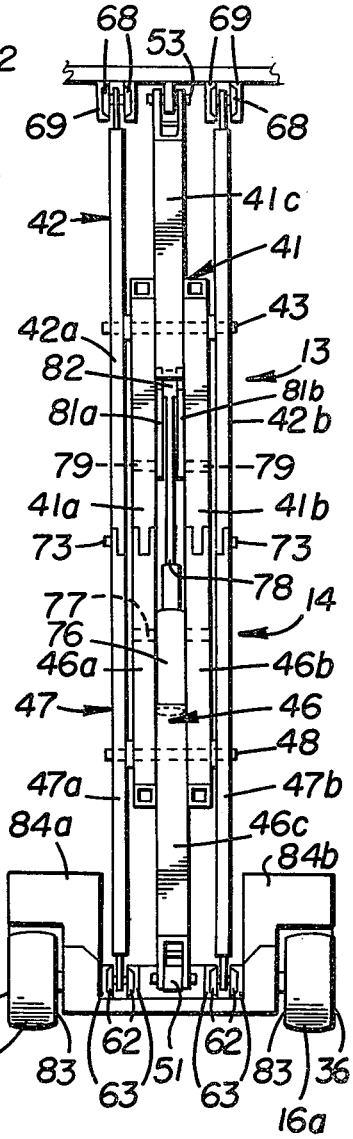
FIG. 4 is an end elevational view of the mobile scaffold of FIG. 1 with the work platform fully elevated.

As best seen in FIGS. 3 and 4, the upper scissors set 13 has an elongated power arm 41 and a stabilizer member 42 pivotally connected to each other intermediate their ends by pivot pin 43. The lower scissors set 14 likewise has an elongated power arm 46 and a stabilizer member 47 pivotally connected to each other intermediate their ends by pivot pin 48. Power arms 41 and 46 are each substantially longer than the end-to-end length of main work platform 12.

Pivot pin 51 pivotally connects end 52 of the lower power arm 46 to end 17 of base frame 11, while pivot pin 53 connects end 54 of the upper power arm 41 to end 22 of the work platform. The other ends 56 and 57 of power arms 41 and 46 are pivotally connected together by pivot pin 58.

Means 59 movably interengages end 61 of the lower stabilizer member 47 with end 19 of frame 11. As best seen in FIG. 4, stabilizer member 47 preferably comprises a pair of stabilizer arms **47*a* and 47*b*, parallel with each other and one on either side of power arm 46. Means 59 comprises rollers 62 on the ends 61 of each of the stabilizer elements 47*a* and 47*b*, the rollers 62 being confined in horizontal channel-shaped tracks 63. Tracks 63 are fixed to frame 11 as a part thereof and allow rollers 62 to move lengthwise of frame 11** while preventing the rollers from moving upwardly, downwardly and sidewardly.

Stabilizer member 42 likewise comprises a pair of stabilizer arms **42*a* and 42*b*, parallel to each other and one on either side of the upper power arm 41. Means 66 movably engages end 67 of the upper stabilizer member 42 to end 23 of platform 12, and comprises rollers 68 on the ends 67 of each stabilizer arm 42*a* and 42*b*, the rollers 68 being confined in horizontal, channel-shaped tracks 69. Tracks 69 are fixed to the work platform 12 underneath deck 21, and extend lengthwise of the platform beyond platform end 23. Tracks 69 confine rollers 68 to rolling movement lengthwise relative to platform 12** while preventing movement of the rollers crosswise, or up or down relative to the work platform.

The other ends 71 of stabilizer arms **42*a* and 42*b* and the other ends 72 of stabilizer arms 47*a* and 47*b* are pivotally connected together by pivot pins 73**.

Figure 7:
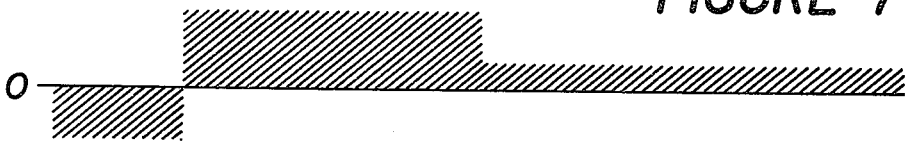
FIGS. 7 and 8 are diagrams illustrating the relative magnitudes of the shears and movement forces on the power arm of FIG. 6 when the work platform is in an elevated position.

As best seen in FIGS. 4 and 7, the upper power arm 41 comprises first, second and third tubular members **41*a*, 41*b*, 41*c*, with tubular members 41*a* and 41*b* being parallel to and spaced apart from each other and extending from end 56 of work member 41 to beyond the pivot pin 43. Tubular member 41*c* extends from end 54 of work member 41 to beyond pivot pin 43 so as to overlap with and between the tubular members 41*a* and 41*b*. The tubular members 41*a*, 41*b* and 41*c* are rigidly connected together, as, for example, by welding, where overlapped to form a unitary rigid elongated beam. The lower power arm 46 is likewise comprised of tubular member 46*a*, 46*b* and 46*c***, overlapped and rigidly secured together.

A hydraulic ram 75 provides the power for elevating work platform 12, ram 75 having a cylinder portion 76 pivotally connected to the tubular members **46*a* and 46*b* of the lower power arm 46 by pivot pins 77 and a piston rod portion 78 pivotally connected to tubular members 41*a* and 41*b* of the upper power arm 41 by pivot pin 79, tension members 81*a* and 81*b*, and pivot pin 82**.

Figure 2:
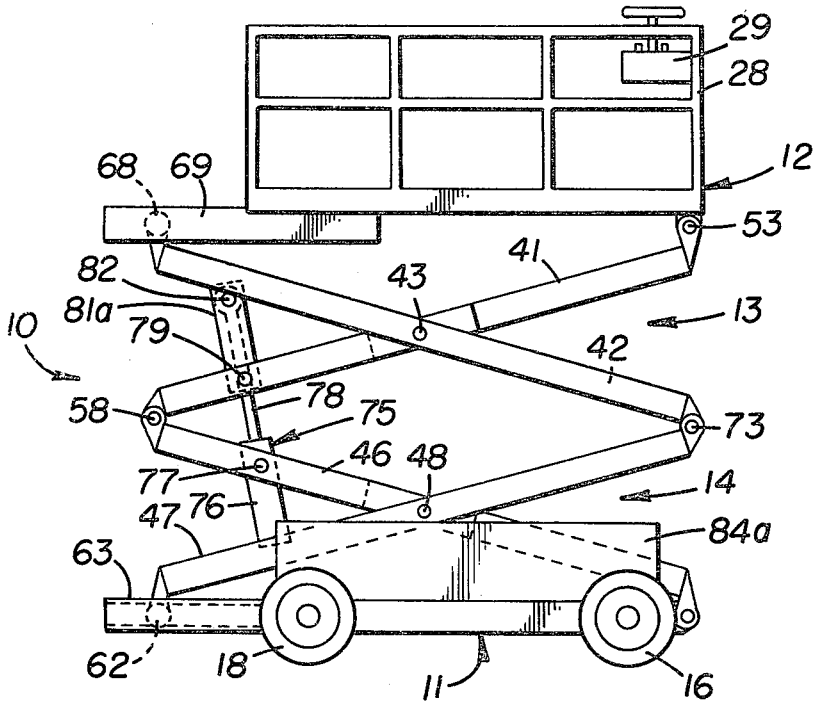
FIGS. 1, 2 and 3 are side elevational views of a mobile scaffold unit constructed in accordance with the present invention and with its work platform in fully lowered, partially elevated, and fully elevated positions, respectively.

The distance from pivot pin 53 to pivot pin 79 is sufficiently greater than the length or work platform 12 so that the upper ends of the tension members **81*a* and 81*b*, extending upwardly from the upper power arm 41, will just clear end 23 of platform 12 (FIG. 2) as the platform is elevated or lowered. The set of tracks 69 associated with the rollers 68 on the upper end of stabilizer element 42*a* are horizontally spaced from the set of tracks associated with stabilizer arms 42b by more than the outside dimension over the tension members 81a and 82c** so that the tension members and cylinder rod may move freely therebetween during raising and lowering of the platform.

As will be noted from the drawings, the pivotal connections of the two scissors sets to each other and of the scissors sets to the base frame and platform are offset from the longitudinal axes of the scissors members so that the scissors members will fold flat when the platform is fully lowered to the position shown in FIG. 1.

As shown in FIG. 4, the spacings between the inner surfaces 83 of the wheels 16,16a and of the wheels 18,18a is substantially greater than the width of the scissors sets 13 and 14 so that the scissors sets can be disposed between the wheels, with the connections 51 and 59 of the lower scissors set 14 being at a level substantially lower than the upper surfaces of the wheels and with sufficient clearance of the steering wheels 16 and 16a with the frame 11 and scissors sets to permit a high degree of maneuverability of the mobile unit.

Compartments 84a and 84b (shown in phantom in FIGS. 1, 2 and 3) are provided on each side of base frame 11 and below platform 12 to house the conventional batteries, hydraulic fluid reservoir, fluid pumps and motors for providing motive power to the wheels and to the hydraulic ram 75. Conventional cables and hoses, not shown, extend from control panel 29 and ram 75 to the equipment in compartments 84a and 84b.

The present invention has a number of significant advantages.

As is seen in FIG. 5, wherein the mobile scaffold unit has a minimum turning radius $R_t$ determined by the maximum pivotal movement of steering wheels 16, 16a, the power arms 41 and 46, and the base and platform tracks 63 and 69 can extend a considerable distance beyond the wheels 18, 18a without interfering with the maneuverability of the unit, such as around relatively tight aisle intersections.

Since the power arms 41 and 46 are relatively long, only two scissors sets are required to achieve acceptable maximum platform height relaive to the wheel base of the unit. With only two scissors sets being needed, the total number of expensive pin connections is held to a minimum.

Figure 8:
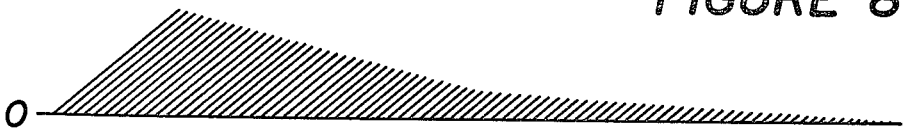

The relative shear and moment forces on the power arms 41 and 46 are shown in FIGS. 7 and 8. The fork construction of the power arms provides two parallel beams i.e., 41a and 41b, where the forces are greatest, and a single beam 41c where the forces are relatively low. Such construction, which matches the amount of material used in the forces imposed thereon, results in an efficient use of material and in less weight and cost.

The stabilizer arms 42 and 47 are not used to provide lifting power to the platform 12 but serve merely to provide vertical support for the free end 23 of the platform. As a consequence, the stabilizer arms 42 and 47 can be made of lighter construction than that of the power arms 41 and 46. In turn, this decreases the amount of weight of the scissors sets which must be elevated by ram 75.

The narrowness of the scissors sets 13 and 14 enables the scissors sets to be located between the wheels of the unit, with the pivot pin 51 and rollers 62 being a level substantially below the upper surface of the wheels. This, plus the fact that only two scissors sets are needed, enables the minimum platform height to be quite low, so that the unit can pass under low overhanging obstructions and provide ease and convenience for the loading of tools and materials onto the platform from the ground level.

I claim:

1. An elevatable work platform apparatus comprising:

a horizontal frame, a generally rectangular and horizontal work platform above said frame member, said work platform having a given length and width, upper and lower scissors sets, each set having an elongated power arm and an elongated stabilizer member, said power arm and stabilizer member of each set being pivotably connected to each other, said power arms each being longer than the length of said work platform.

means pivotally connecting one end of the lower power arm to one end of said frame, means pivotally connecting one end of the upper power arm to one end of said work platform, means pivotally connecting the other ends of said lower and upper power arms together, means movably interengaging one end of the lower stabilizer member with the other end of said frame, means movably interengaging one end of the upper stabilizer member with the other end of said work platform, means pivotally connecting the other ends of said lower and upper stabilizer members together, a generally vertical ram having a cylinder and piston rod portions, means pivotally connecting said cylinder and piston rod portions to said lower and upper power arms, with part of said ram extending upwardly from said upper power arm, and with the distance from the pivotal connection of said upper power arm and said work platform to the pivotal connection of said upper power arm and the ram portion connected thereto being greater than the distance from the pivotal connection of said upper power arm and said work platform to the other end of said work platform.

2. Apparatus as set forth in claim 1 wherein each of said power arms comprises first, second and third tubular members, said first and second tubular members being parallel to and spaced apart from each other and extending from said other end of said power arm to beyond the pivotal connection of the power arm and the stabilizer member associated therewith, and said third tubular member extending from said one end of said power arm to beyond said pivotal connection of said power arm and stabilizer member so as to overlap with and between said first and second tubular members, said third tubular member being rigidly connected to said first and second tubular members where overlapped.

3. Apparatus as set forth in claim 2 wherein the stabilizer member of each of said upper and lower scissors sets comprises a pair of stabilizer arms parallel with each other and one on either side of the power arms to which they are pivotally connected.

4. Apparatus as set forth in claim 3 wherein said means movably interengaging one end of the upper stabilizer member with the other end of said work platform comprises a pair of tracks fixed to said work platform and extending lengthwise of said work platform and beyond said other end of said platform, said tracks being spaced horizontally from each other by an amount sufficient to enable said ram portion connected to said upper power arm to fit between said tracks, and a roller mounted on the one end of each upper stabilizer arm and in rolling engagement with one of said tracks.

5. Apparatus as set forth in claim 1 and further includes:

first and second pairs of wheels mounted on said frame, the wheels of said first pair being spaced below the corners of said work platform at said one end thereof, the wheels of said second pair being spaced below the corners of said work platform at said other end thereof, said upper and lower scissors sets each having a width less than the spacing between the inner surfaces of the wheels of each pair thereof, said one ends of said power arm and stabilizer member of said lower scissors set being pivoted and engaged with said frame at a level substantially lower than the upper surfaces of said wheels.

6. Apparatus as set forth in claim 5 wherein each of said power arm comprises first, second and third tubular members, said first and second tubular members being parallel to and spaced apart from each other and extending from said other end of said power arm to beyond the pivotal connection of the power arm and the stabilizer member associated therewith, and said third tubular member extending from said one end of said power arm to beyond said pivotal connection of said power arm and stabilizer member so as to overlap with and between said first and second tubular members, said third tubular member being ridiidly connected to said first and second tubular members where overlapped.

7. Apparatus as set forth in claim 6 wherein the stabilizer member of each of said upper and lower scissors sets comprises a pair of stabilizer arms parallel with each other and one on either side of the power arm to which they are pivotally connected.

8. Apparatus as set forth in claim 7 wherein said means movably interengaging one end of the upper stabilizer member with the other end of said work platform comprises a pair of tracks fixed to said work platform and extending lengthwise of said work platform and beyond said other end of said platform, said tracks being spaced horizontally from each other by an amount sufficient to enable said ram portion connected to said upper power arm to fit between said tracks, and a roller mounted on the one end of each upper stabilizer element and in rolling engagement with one of said tracks.

9. An elevatable work platform apparatus comprising:

a horizontal frame, a horizontal work platform above said frame member, upper and lower scissors sets, each scissors set having an elongated power arm comprised of first, second and third tubular members, said first and second tubular members being parallel to and spaced apart from each other and said third tubular member being overlapped with and between said first and second tubular members, said third tubular member being rigidly connected to said first and second tubular member when overlapped, each scissors set having a pair of elongated stabilizer arms parallel with each other and on either side of the power arm of the scissors with which the stabilizer arms being pivotally connected intermediate their ends to the tubular members of such power arm when overlapped, means pivotally connecting the third tubular member of the lower power arm to one end of said frame, means pivotally connecting the third tubular member of the upper power arm to one end of said work platform, means pivotally connecting the first and second tubular members of said lower power arm to the first and second tubular members of said upper power arm, means movably interengaging one end of the upper stabilizer arm with the other end of said work platform, means pivotally connecting the other end of said lower stabilizer arms with the other ends of said upper stabilizer arms, an extensible ram having a cylinder portion and a piston rod portion, means pivotally connecting one of said ram portions to and between the first and second tubular members of the upper scissors set power arm, means pivotally connecting the other of said ram portions to and between the first and second tubular members of the lower scissors set power arm.

10. Apparatus as set forth in claim 9 and further including:

a first pair of wheels mounted on one end of said frame, a second pair of wheels mounted on the other end of said frame, said upper and lower scissors sets each having a width less than the spacing between the inner surfaces of the wheels of each pair thereof, said power arm and stabilizer arms of said lower scissors set being pivoted and engaged with said frame at a level substantially lower than the upper surfaces of said wheels.

* * * * *